US006651900B1

(12) United States Patent
Yoshida

(10) Patent No.: US 6,651,900 B1
(45) Date of Patent: Nov. 25, 2003

(54) CONTROL APPARATUS FOR A FIRE PUMP, OPERATION DISPLAY APPARATUS FOR A FIRE PUMP AND OPERATION MODE CONTROL APPARATUS FOR A FIRE PUMP

(75) Inventor: Kenichi Yoshida, Tokyo (JP)

(73) Assignee: Fuji Jakogyo Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/715,014

(22) Filed: Nov. 20, 2000

(30) Foreign Application Priority Data

Nov. 29, 1999 (JP) ..... 11-337962
Nov. 29, 1999 (JP) ..... 11-337964
Nov. 29, 1999 (JP) ..... 11-337965

(51) Int. Cl.[7] ..... B67D 5/08

(52) U.S. Cl. ..... 239/72; 239/67; 239/71; 169/13; 169/24; 417/18; 417/34

(58) Field of Search ..... 169/5, 13, 52, 169/24; 239/67, 68, 69, 74, 71, 72; 417/12, 18, 32, 34; 340/320

(56) References Cited

U.S. PATENT DOCUMENTS 3,786,869 A * 1/1974 McLoughlin ..... 169/24
4,189,005 A * 2/1980 McLoughlin ..... 169/24
4,611,290 A * 9/1986 Henningsen et al. ..... 169/13
5,109,534 A * 4/1992 Naito et al. ..... 340/320
5,221,189 A * 6/1993 Henningsen ..... 417/12
6,009,953 A * 1/2000 Laskaris et al. ..... 169/13

FOREIGN PATENT DOCUMENTS

| | | |
|---|---|---|
| JP | 5-231172 | 9/1993 |
| JP | 8-252339 | 10/1996 |
| JP | 9-154974 | 6/1997 |
| JP | 10-15105 | 1/1998 |

* cited by examiner

*Primary Examiner*—Steven J. Ganey
(74) *Attorney, Agent, or Firm*—Smith, Gambrell & Russell LLP

(57) ABSTRACT

In a fire pump adapted to force out the water, which is pumped from a water source, from a nozzle provided at a front end portion of a delivery hose, a nozzle control unit 8 adapted to control the fire pump remotely is provided in the vicinity of the nozzle. The nozzle control unit 8 is connected to a body of the fire pump 1 by power source lines 33. On the nozzle control unit 8, a control instruction unit for instructing an operating mode of the pump 1, and a numerical value display unit for displaying the operation condition of the fire pump are provided. The transmitting and receiving of an operation control signal and a condition display signal are done between the pump 1 and nozzle control unit 8 by power line communication via the power source lines 33, whereby the operation condition of the pump 1 is feedback displayed in real time in response to a control operation of a nozzle operator.

3 Claims, 9 Drawing Sheets

| ERROR CODE | ABNORMALITY INFORMATION |
|---|---|
| Err. 1 | ABNORMALITY OF DISCHARGE WATER PRESSURE SENSOR |
| Err. 2 | ABNORMALITY OF FLOW RATE SENSOR |
| Err. 3 | ABNORMALITY OF SUCTION WATER PRESSURE SENSOR |
| Err. 4 | ABNORMALITY OF START-UP |
| Err. 5 | ABNORMALITY OF SUCTION/DISCHARGE WATER |
| Err. 6 | ABNORMALITY OF ENGINE STOP |
| Err. 7 | OTHER ABNORMALITY |

CONTROL APPARATUS FOR A FIRE PUMP, OPERATION DISPLAY APPARATUS FOR A FIRE PUMP AND OPERATION MODE CONTROL APPARATUS FOR A FIRE PUMP

BACKGROUND OF THE INVENTION

1. Field of the Invention

This invention relates to fire pump control techniques, and more particularly to a control apparatus for a fire pump. In a fire pump having a fire pomp body and a nozzle connected to the pump body via a delivery horse, such a control apparatus is formed at a side of the nozzle so as to enable the controlling of an operation of a fire pump body and the displaying of the operation condition of the same to be done in real time.

The present invention also relates to an operation display unit for a fire pump, and more particularly to an operation display apparatus for a fire pump which enable not only the controlling of an operation of the fire pump and the displaying of the operation condition of the fire pump.

Further, the present invention relates to a operation mode control apparatus for a fire pump, and more particularly to a operation mode control apparatus for a fire pump having an automatic relay water supply mode in which, when the relay water supply from a water source to plural fire pumps connected in series is carried out, the water supply from a fire pump on a preceding stage is detected to start an operation of a fire pump automatically.

2. Description of the Related Art

In a fire extinguishing activity using a fire pump (which will hereinafter be referred to "pump"), the water is generally supplied from the pump by using a delivery hose connected to a pump body, and forced out from a nozzle fixed to a front end portion of the delivery hose. During this time, a pump operator who carries out an engine starting operation, a throttle regulating operation and valve opening and closing operations and the like is specially stationed on the side of the pump. The fire extinguishing activity is carried out as the pump operator makes contact with a nozzle operator.

Such operators' contact with each other is made by using a flag-signal and the like when the operators are in an area in which they can see each other visually, and by radio communication using a transceiver and the like when a scene of a fire is far away from a pump or when there are obstacles, such as houses, living trees and the like between the scene of a fire and pump. In these cases, a communication worker, who is other than the nozzle operator, is stationed on the side of the nozzle and moves with the nozzle operator. The communication worker is engaged in making contact with a worker on the side of the pump.

When a pump is distant from a scene of a fire, the pump is controlled remotely by radio in some cases from the side of the nozzle as disclosed in Japanese Patent Unexamined Publication No. Hei. 8-252339. According to the techniques disclosed in this publication, a communication worker carrying a radio transmitter with him moves with a nozzle operator and controls a vehicle-mounted pump and the like remotely on the side of the nozzle, whereby a fire extinguishing activity is carried out. This serves to attain the relieving a nozzle operator, who moves in a dangerous place, of a work load.

Providing a handy pump operating member in the vicinity of a nozzle and operating a pump remotely from the side of the nozzle as disclosed in Japanese Patent Unexamined Publication No. Hei. 5-231172 have also been proposed. In this case, the handy operating member is provided with buttons for carrying out engine starting and stopping operations and an operation for instructing a degree of opening of a throttle. A pump body and the handy operating member are connected together by a lead wire. This enables a nozzle operator to control remotely on the side of the nozzle the starting of the discharging of water and the regulating of a water pressure, whereby an accurate fire extinguishing activity can be carried out even when the communication between the pump operator and nozzle operator is hindered.

A fire pump such as a portable fire pump has heretofore been provided with an operation display unit on which switches, keys and various kinds of meters are arranged for the purpose of controlling an operation of the pump and displaying the condition of the operation thereof. For example, a portable fire pump is provided on its upper surface with a power source ON/OFF switch, an engine throttle operating key, a discharge water pressure gauge, etc. An operator carries out an operation of a throttle as he observes various kinds of meters, and regulates an operation condition of the pump suitably.

When a scene of a fire, such as a forest fire is far away from a water source, the so-called relay water supply in which plural portable fire pumps are connected in series to carry out a long distance water supply operation has heretofore been done. For example, Japanese Patent Unexamined Publication No. Hei. 9-154974 discloses a structure for carrying out a relay water supply operation with fire pumps (which will hereinafter be referred to pumps) connected in plural stages. The pumps on a second stage onward in this structure are started automatically when the water supply from a preceding stage is sensed, whereby the relay water supply is carried out without stationing an operator on each stage.

Japanese Patent Unexamined Publication No. Hei. 10-15105 also discloses a pump adapted to sense the water supply and carry out a relay water supply operation. In this pump, a water pressure and an air pressure are distinguished from each other by a difference between a pressure at an inlet side portion of the pump and a pressure at an outlet side portion thereof in view of a problem of the occurrence of an erroneous actuation of an installed water pressure sensor due to the fluctuation of an air pressure during the relay water supply.

In a pump adapted to carry out such an automatic relay water supply operation, the switching of a regular water discharging operation carried out by a single pump and a relay water supply operation from one to the other is done by an operation of a switch, and such operations of the pump are set by an operator by whom a operation mode is switched suitably on a pump body or by a remote control unit.

However, in the remote control system disclosed in the above-mentioned Japanese Patent Unexamined Publication No. Hei. 8-252339, the communication worker is needed in addition to the nozzle operator, and the communication between the communication worker and the nozzle operator in an extremely noisy scene of a fire cannot be made freely in some cases. Therefore, this remote control system has a problem concerning an operation efficiency thereof.

In the remote control system disclosed in the above-mentioned Japanese Patent Unexamined Publication No. Hei. 5-231172, the nozzle operator can control the pump by himself but he cannot grasp the operation condition of a pump in real time since there is not a response to the nozzle operator's operation. Namely, the nozzle operator cannot get information on whether the engine has really been stopped or information on whether the regulation of the degree of opening of a throttle (the regulation of a water pressure) has been carried out as intended, until variation of a water discharge rate, etc. has occurred after the execution of the pump operating work. Therefore, this remote control system has a problem concerning the capability of the system of transferring information to the nozzle operator.

In a related art operation display unit, data necessary for the controlling of an engine, such as a revolution frequency of an engine and an engine cooling temperature were not always displayed, and there were many portions of an operation of the fire pump which were judged by an operator's experience on the basis of a sound of an engine and the like. Moreover, the meters provided on a related art operation display unit were analog meters. Therefore, pointers of the meters were not stabilized due to the pulsation of a discharge pressure, etc., and the reading of a value indicated by the pointer was not easily done. Especially, when a controller is provided in a position away from a pump body so that a remote control operation can be carried out, a judgement based on a sound of the engine could not be made. Also, it was impossible to accurately grasp the condition of the pump and control the pump remotely.

On the other hand, it is hard to say that consideration is given to the switch and keys provided on the operation display unit, with respect to the controllability and an erroneous operation thereof. Studying measures to attain the improvement of the capability of the apparatus of ascertaining an operation of these parts, and measures to prevent an operator's inadvertent touch thereon has been demanded.

Further, in a case where a pump is formed so that, every time a mode switching switch is pressed for carrying out such a operation mode switching operation, a operation mode is switched and fixed to a switched mode, when an input water pressure of not lower than a predetermined level is detected by a water pressure sensor, an operation mode cannot be switched to an automatic relay water supply mode onward in some cases.

Namely, an automatic relay water supply mode is set so that, when an input water pressure reaches a predetermined level, an engine is started automatically to start a relay water supply operation. Therefore, when an input water pressure is not lower than a starting pressure, an inconvenience occurs, i.e., the moment an actual mode is switched to an automatic relay water supply mode during a operation mode switching operation, the engine is started to cause a relay water supply operation to be started and fixed, and the mode cannot be shifted to any further mode. Namely, when no other modes can be selected unless an actual mode is once switched to an automatic relay water supply mode, the automatic relay water supply mode is necessarily selected even for a moment. In such a case, modes beyond the automatic relay water supply mode cannot be selected.

Moreover, when the pump is once operated in a relay water supply mode and then a power source is turned off, a mode used prior to the turned-off of the power source is memorized, so that, when the pump is newly operated, the operation is started in the memorized mode. Consequently, when the power source is turned off so as to stop the relay water supply mode, the pump is operated in the relay water supply mode in the end, and cannot get out of the mode.

SUMMARY OF THE INVENTION

Accordingly, a first object according to the present invention is to provide a control apparatus for a fire pump, capable of not only controlling a pump remotely but also grasping the operation condition of the pump in real time, and having excellent operation controllability and information transfer capability.

A second object according to the present invention is to provide an operation display apparatus for a fire pump, capable of carrying out various control and display operations, and having excellent controllability and safety.

A third object according to the present invention is to provide a operation mode control apparatus for a fire pump having an automatic relay water supply mode, and capable of preventing the setting of a mode during a mode switching operation.

The first object can be achieved by a control apparatus for a fire pump according to a first aspect of the present invention. The control apparatus for a fire pump, the fire pump having a fire pump body, a delivery hose connected to the fire pump body at one end thereof, a nozzle connected to the other end of the delivery hose, and a power source line for supplying electric power to the control apparatus, the control apparatus disposed in the vicinity of the nozzle comprising:

an operation control unit for instructing an operation mode of the fire pump and for transmitting an operation control signal corresponding to the instructed operation mode to the fire pump body via the power source line and receiving a condition display signal from the fire pump body via the power source line; and a condition display unit for displaying an operation condition of the fire pump on the basis of the condition display signal received by the operation control unit.

According to the present invention, the fire pump body and the control apparatus are connected together via the power source lines, and the transmitting and receiving of an operation control signal and a condition display signal are done between the fire pump body and nozzle control apparatus by power line communication made via the power source lines. Therefore, the operation condition of the fire pump is feedback displayed in real time in response to a nozzle operator's control operation. Accordingly, the nozzle operator can instantly ascertain an effect of his operation, and an accurate and speedy information transfer operation can be carried out. It also becomes possible to carry out an efficient operation of the apparatus and an efficient water discharging operation on the nozzle operator's judgement, and attain the improvement of the operation efficiency and labor effectiveness.

In the case of this control apparatus, call signals may be transmitted and received by the same apparatus and fire pump body by making power line communication via the power source lines. This enables vocal communication to be made between the nozzle side and the side of the pump body, and communication, such as the reporting of the actual condition and the making of a request for starting an action, and so forth to be made momentarily.

A revolution frequency of the engine of the fire pump may also be displayed as an element, which shows the operation condition of the fire pump, on the condition display member. This enables the nozzle operator to determine the revolution frequency of the engine in real time, and instantly recognize a reaction against an operation in the operation control unit.

The transmission of a signal from the control unit to the fire pump body may also be carried out by superposing FM waves on the power source lines. This enables the reduction of the noise of an operation control signal sent out from the extremely noisy nozzle side to be attained, and more reliable signal transmission to be effected.

In addition, the transmission of a signal from the fire pump body to the control unit may also be carried out by superposing AM waves on the power source lines.

The second object can be achieved by an operation display apparatus for a fire pump according to a second aspect of the present invention. The operation display apparatus for a fire pump, the operation display apparatus comprising:

an operation unit for controlling an operation of the fire pump and for generating a sound corresponding to the control thereof; and a display unit for displaying operation information on the fire pump corresponding to the operation of the fire pump controlled by operation unit. In the above-mentioned operation display apparatus, the operation unit may generate the sound at every control thereof.

According to the present invention, an operation reception sound, for example, a piping sound is produced every time an operation is carried out, so that an operator can certainly ascertain the fact that the apparatus has received the operation. Moreover, an operation information corresponding to an operation is displayed, and what is thus displayed arouses an operator's attention to the switching of a mode, etc., and enables the operator to know the operation condition of the pump accurately.

In this case, the display unit may be formed so that a numerical value and a predetermined message are displayed by a 7-segment display unit. This enables various kinds of data to be displayed digitally, and not only data of the numerical value but also various kinds of messages, such as "FULL" and the like to be displayed. It also becomes possible to ascertain operation information by a digital display method without reading an indication of a pointer of an analog meter, obtain accurate information on the condition of the pump more extensively, and operate the pump more accurately. A plasma display can also be used as the display unit, and, in this case, more variegated information can be displayed.

The display unit may also be formed so as to display at least one of a revolution frequency of a fire pump driving engine, a cooling water temperature, a discharge pressure of the pump and a discharge flow rate of the pump. This enables operation information including a revolution frequency of the engine, a temperature of engine cooling water, a discharge pressure of the pump, a discharge flow rate of the pump, etc., which an operator has heretofore been unable to know, to be obtained easily by only a switching operation of the operator.

When a failure is detected in any of various kinds of sensors, which are provided on the fire pump and in a constantly monitored state while a power source is in an ON-state, a predetermined error displaying operation set in advance correspondingly to the relative broken-down sensor may be carried out. This enables the pump to have a function of diagnosing the abnormality of a sensor, and the results of the diagnosis to be known to an operator by further utilizing the function of the display unit.

In addition, the operating unit may be provided with a key for judging that an operation is effective only when the operation is carried out continuously for a predetermined period of time, and, for example, an engine stopping key can be set as such a key. This enables the occurrence of an unexpected erroneous operation due to an operator's inadvertent touch on the key to be prevented. For example, an engine stopping key can prevent only an operator's touch on the key from causing a power source to be turned on and off.

The operating unit may also be provided relative to a water pressure detecting sensor for detecting a pressure of the water supplied to a fire pump with a key for setting as a reference value a pressure attained when the sensor is operated. For example, when a position of a water source is higher than that of a pump as in a case where a roof water supply source is used, an error occurring in a value detected by a sensor due to the atmospheric pressure can be corrected, and a more accurate control operation can be carried out.

The above-described operation display apparatus may be provided not only on the mentioned fire pump but also on a remote control system provided separately from the fire pump.

The third object can be achieved by an operation mode control apparatus for a fire pump according to a third aspect of the present invention. The operation mode control apparatus for a fire pump having at least operation modes of the fire pump, the operation mode control apparatus comprising:

an operation mode switching unit switching operation modes; and a mode setting delay unit for delaying, when the operation mode is switched by the operation mode switching unit, the setting of the switched operation mode for a predetermined period of time. In the above-mentioned operation mode control apparatus, one of the operation modes is an automatic relay water supply mode in which the fire pump detects the water supply from a fire pump on a preceding stage and then starts the relay water supply automatically.

According to the present invention, when a operation mode is switched by a mode switching unit, a operation mode switched thereby is not fixed instantly. Therefore, even in a case where some other mode cannot be selected unless a pump passes through an automatic relay water supply mode as in a related art pump, an actual operation mode can be shifted without difficulty to a operation mode beyond the automatic relay water supply mode. Accordingly, for example, in order to select some other operation mode through an automatic relay water supply mode with an input water pressure of a pump which receives water sent from a pump on a preceding stage higher than a pump starting water pressure in the automatic relay water supply mode, the mode is not fixed instantly to "automatic relay water supply mode" while the pump passes through the automatic relay water supply mode, i.e., a mode selecting operation can be carried out freely.

DETAILED DESCRIPTION OF THE PREFERRED EMBODIMENTS

Figure 1:
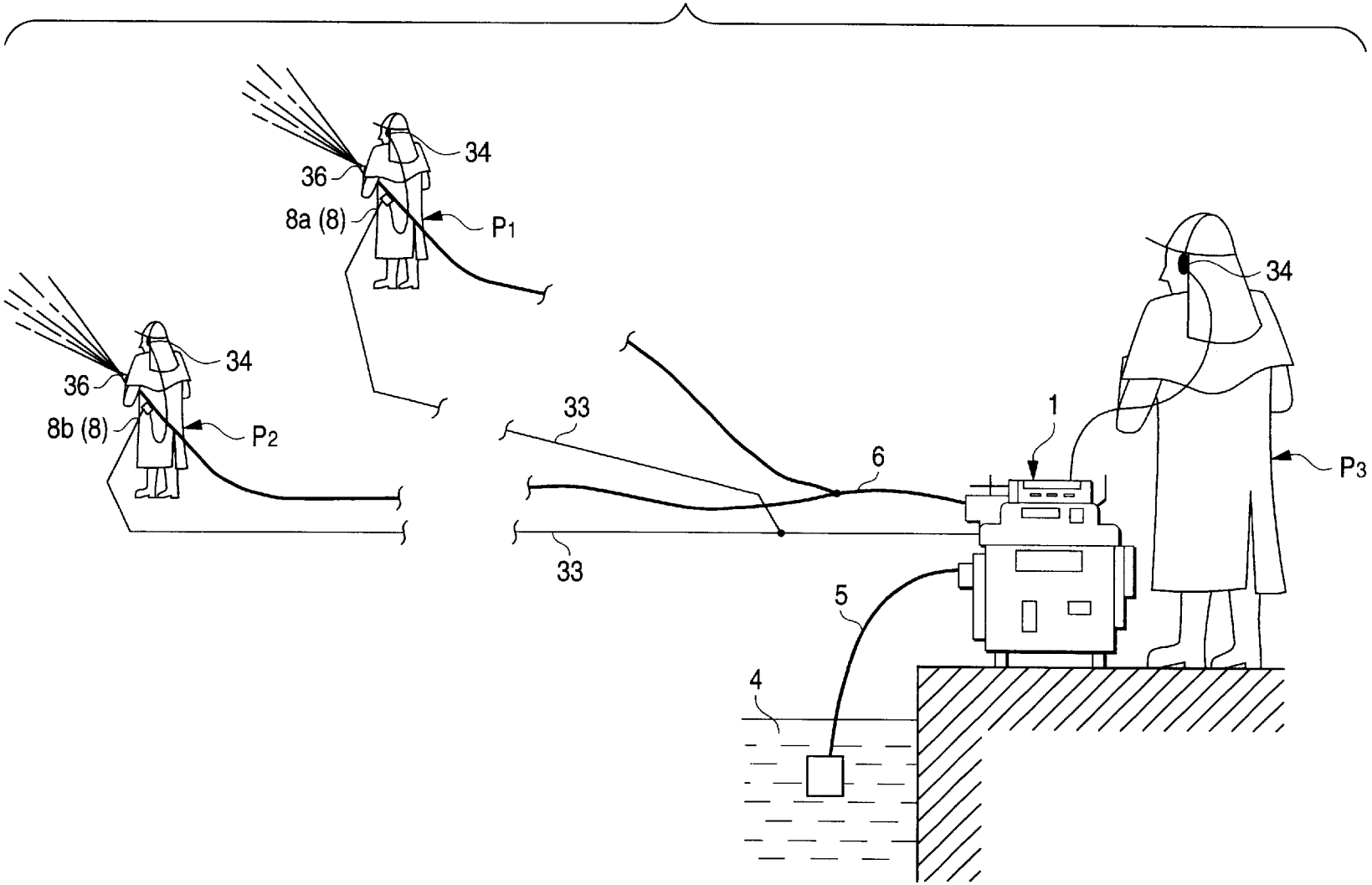
FIG. 1 is an illustration showing a general construction of a fire pump control system using a nozzle control unit of an embodiment according to the present invention.
Figure 2:
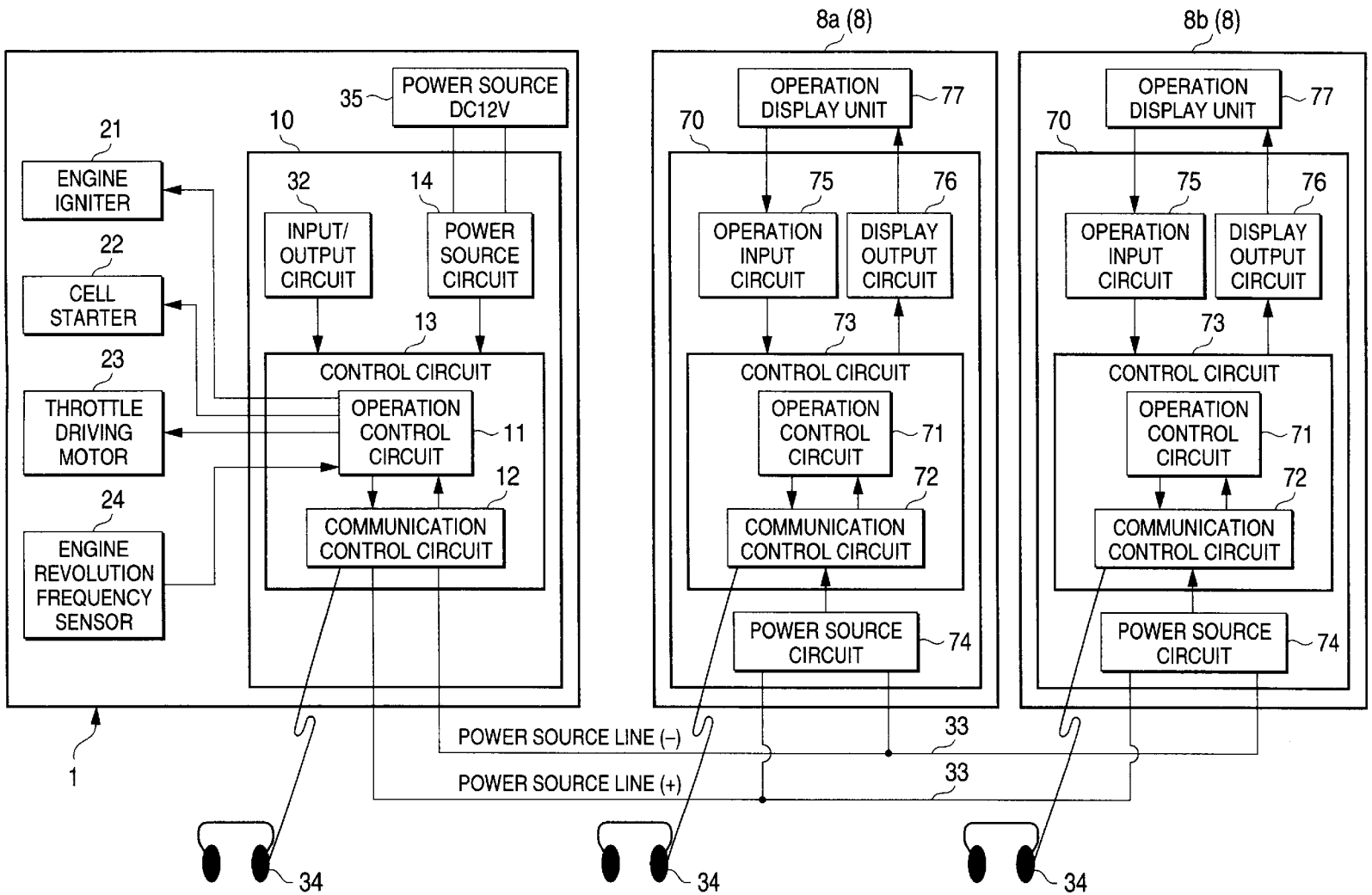
FIG. 2 is an illustration showing the construction of a control system in the system of FIG. 1.

A mode of embodiment of the present invention will now be described in detail on the basis of the drawings. FIG. 1 illustrates a general construction of a fire pump control system using a nozzle control unit of an embodiment according to the present invention. FIG. 2 illustrates the construction of a control system in the system of FIG. 1.

In this system, a fire pump body of a fire pump 1 and nozzle control units 8 (8*a*, 8*b*) are connected together via power source lines 33 so as to not only control the pump 1 remotely on the side of the nozzle control unit 8 but also display the condition thereof. In this case, the supplying of electric power via the power source lines 33 is done with respect to the nozzle control unit 8 with a weight load of a battery and the consumption of the same taken into consideration. The transmission of signals between the pump 1 and nozzle control unit 8 is carried out by digital cable power line communication made via the power source lines 33. This system is formed so that five nozzle control units 8 at most can be provided.

The system of FIGS. 1 and 2 is an example using a portable pump as the pump 1. The pump 1 is provided with a water cooled 2-cycle engine, and a vacuum pump driven thereby. The water is pumped up from a water source via a suction pipe 5, and sent into a delivery hose 6 as a flow rate and water pressure are regulated by the pump 1. Nozzles 36 are fixed to front end portions of the delivery hose 6, and the water sent through the delivery hose 6 is forced out from the nozzles 36.

The pump 1 in this system is controlled by a main controller 10 formed of a microcomputer held in the pump 1. The main controller 10 is provided as shown in FIG. 2 with a control circuit 13 having a operation control circuit 11 and a communication control circuit 12. In this case, the operation control circuit 11 and communication control circuit 12 are provided with a CPU, a ROM, a RAM, a timer, an input/output (I/O) member, an A/D converter and the like which are not shown, and the controlling of the engine, etc. is done on the basis of detected data from various kinds of sensors. Namely, various kinds of actuators, such as an engine igniter 21, a cell starter 22, a throttle driving motor 23, etc. and various kinds of sensors, such as an engine revolution frequency sensor 24, an engine cooling water temperature sensor (not shown), a discharge water pressure sensor (not shown), etc. are connected to the operation control circuit 11.

The main controller 10 is further provided with a power source circuit 14 and an input/output circuit 32. The power source circuit 14 is connected to a battery 35 and adapted to supply a power source current to the control circuit 13. The input/output circuit 32 is adapted to carry out the transmitting and receiving of signals between the input/output circuit 32 and an operation display panel (not shown) provided on the pump 1.

Figure 3:
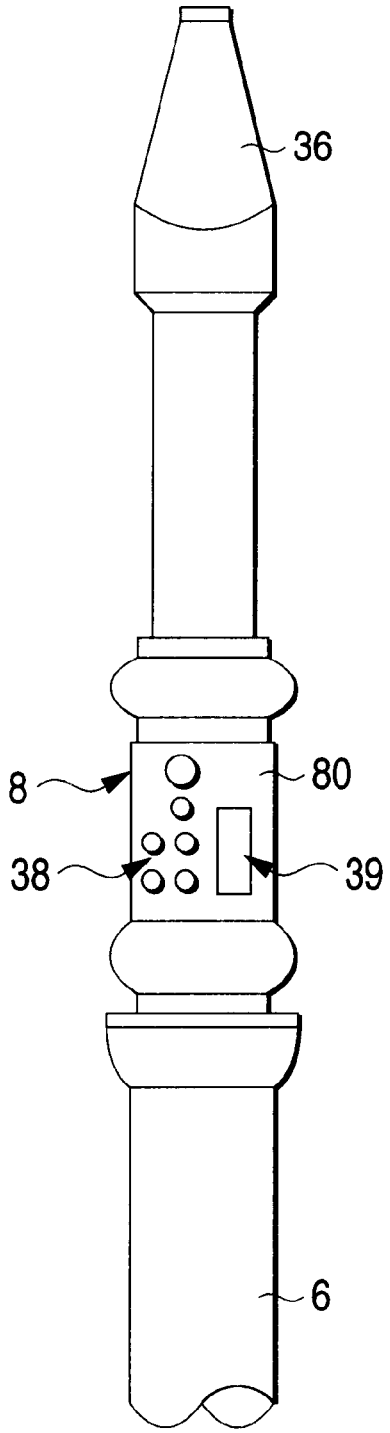
FIG. 3 is an illustration showing a fixed condition of the nozzle control unit.

The nozzle control unit 8 is provided in the vicinity of the nozzle 36 fixed to a front end portion of the delivery hose 6. FIG. 3 illustrates the fixed condition of the nozzle control unit 8. In this system, the nozzle control unit 8 is connected to the pump 1 by the power source lines 33, and the transmission of signals is carried out between these two by power line communication. Although, in FIG. 1, the delivery hose 6 and power source lines 33 are shown separately for having the system construction understood easily, digital cables constituting the power source lines 33 are actually arranged along the delivery hose 6, i.e., wires are arranged on an irreducible minimum scale with the efficiency of maintenance work for the system taken into consideration.

The nozzle control unit 8 is also provided with a controller 70 formed of a microcomputer as shown in FIG. 2. The controller 70 is provided with a control circuit 73, a power source circuit 74, an operating input circuit 75 and a display output circuit 76. The operating input circuit 75 and the display output circuit 76 are connected to an operation display unit 77.

The control circuit 73 is provided with an operation control circuit 71 and a communication control circuit 72. The communication control circuit 72 is connected to the power source lines 33 via the power source circuit 74. The control circuit 73 is formed so as to receive electric power supply from the power source lines 33. The power source lines 33 are further connected to the communication control circuit 12 in the main controller 10 of the pump 1. Namely, the nozzle control unit 8 is adapted to receive electric power supply from the pump 1 via the power source lines 33. Further, the transmission and reception of signals between the nozzle control unit 8 and pump 1 is carried out via the power source lines 33.

Figure 4:
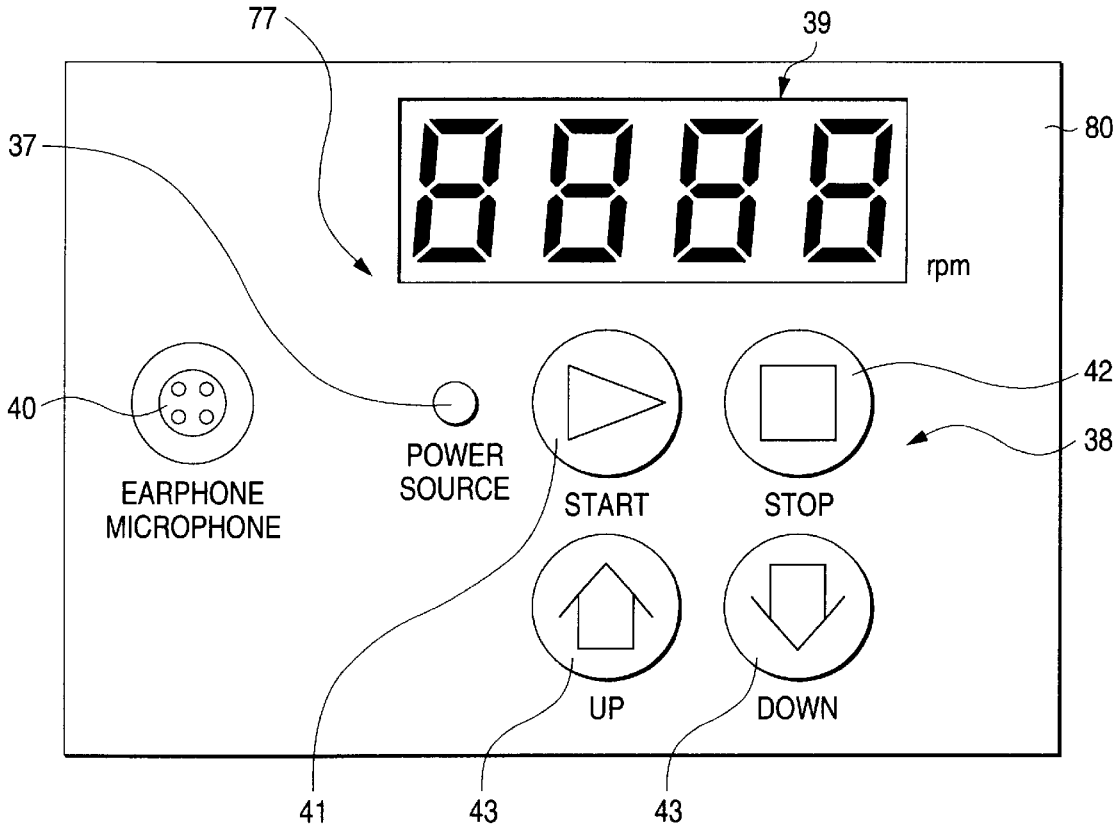
FIG. 4 is an illustration showing the construction of an operating surface of the nozzle control unit.

FIG. 4 illustrates the construction of an operating surface 80 of the nozzle control unit 8. The operating surface 80 is provided with a power source lamp 37, a control instruction unit 38 and a numerical value display unit (condition display unit) 39 as parts constituting an operation display unit 77. The control instruction unit 38 is adapted to instruct an operating mode of the pump 1. The numerical value display unit (condition display unit) 39 is adapted to display the operation condition of the pump 1. The operating surface 80 is provided with an earphone microphone terminal 40 connected to the communication control circuit 72 with the control display unit 77.

The power source lamp 37 is lit when a power source of the body of the pump 1 is turned on, to notify a nozzle operator of the ON/OFF condition of the pump power source. The control instruction unit 38 is provided with an engine starting key, an engine stopping key 42 and a throttle operating key 43. By these keys, the starting and stopping of an engine and the regulating of the degree of opening of a throttle can be done.

In this case, when each key is operated, a sound of action, i.e. a piping sound, etc. is produced so that an operator can get a clear recognition that the apparatus has accepted the relative operation, and also so as to arouse the operator's attention to the fact that the key has been operated. The engine stopping key 42 is set so that the turning on or off of the power source cannot be done unless this key is pressed continuously for t seconds (for example, 3 seconds), for the purpose of preventing the power source from being turned on or off by an unexpected erroneous operation, such as an operator's sudden key contacting action and the like.

On the numerical display unit 39, a revolution frequency of the engine is displayed as a sign of the operation condition of the pump 1 by a 7-segment display device. The numerical display unit 39 may be adapted to display various kinds of messages, for example, when the throttle is fully opened, a message "FULL" can be displayed thereon. Instead of the 7-segment device, a plasma display device may be used. In this case, "START" and "STOP", etc. can be displayed when the engine starting key 41 and engine stopping key 42 are pressed respectively.

An earphone microphone 34 is connected to the earphone microphone terminal 40 for making communication with a pump operator. In this case, it is desirable that a vocal cord microphone (bone microphone) be used as a talking device so that the operators can converse with each other even in the noise of a scene of a fire. Owing to this earphone microphone 44, vocal communication is made between the nozzle operators $P_1$, $P_2$ and pump operator $P_3$ on the side of the body of the pump 1. Therefore, a water discharging operation can be carried out efficiently as the operators observe the scene of a fire as a whole.

When a key on the operating surface 80 is pressed in such a nozzle control unit 8, a relative command is inputted into the control circuit 73 via the operation input circuit 75. In the control circuit 73 receiving this command, an operation control signal is outputted from the communication control circuit 72 to the power source lines 33 via the power source circuit 74 on the basis of a command from the operation control circuit 71. Consequently, the operation control signal is transmitted via the power source lines 33. In this case, the operation control signal is transmitted by FM waves so as to lower the noise.

When the engine starting key 41 is operated, for example, in the nozzle control unit 8*a*, an operating signal generated is transmitted to the "communication control circuit 72→power source circuit 74→power source lines 33→communication control circuit 12". In accordance with a command given by the operation control circuit 11, the cell starter 22 and engine igniter 21 are driven, and the engine of the pump 1 is started. When the throttle operating key 43 is pressed, an operation control signal is sent to the operation control circuit 11 through a similar transmission path to cause a throttle driving motor 23 to be driven, and the degree of opening of a throttle valve to be regulated.

On the other hand, data, such as a revolution frequency of the engine, etc. are outputted as a condition display signal from the side of the pump 1 to the power source lines 33. In this case, the condition display signal is superposed on electric power, and transmitted by AM waves. When such a signal is transmitted from the pump to the nozzle, the noise is less than that in a case where such a signal is transmitted from the nozzle to the pump, and, therefore, AM waves are used. The FM waves may also be used in both of these cases.

With respect to the condition display signal sent out from the side of the pump 1, the operation control circuit 71 of each nozzle control unit 8 obtains the same signal via the power source circuit 74 and communication control circuit 72. Data are read out from this condition display signal obtained, and a data signal is sent to the display output circuit 76. Consequently, data, such as a revolution frequency of the engine, etc. are displayed on the numerical value display unit 39. For example, when the revolution frequency of the engine varies to 3000 rpm by an operation of the throttle operating key 43, a numerical value "3000" is displayed on the numerical value display unit 39. Namely, in the nozzle control unit 8 in the present invention, a revolution frequency of the engine is feedback displayed in a position near the nozzle operator with respect to the operation of the throttle operating key carried out by him on the nozzle. Accordingly, it becomes possible to ascertain in response to the key pressing operation the effect of the same operation in real time, and transmit accurate information speedily to the nozzle operator.

The call through the earphone microphone 34 is also transmitted in the same manner as described above. Namely, during the transmission of a call signal from the nozzle operator to the pump operator, the signal is sent to the "communication control circuit 72→power source circuit 74→power source lines 33→communication control circuit 12", and the voice of the nozzle operator reaches the earphone microphone 34 of the pump operator. During the transmission of a call signal from the pump operator to the nozzle operator, the signal is sent to the "communication control circuit 12→power source lines 33→power source circuit 74→communication control circuit 72", and the voice of the pump operator reaches the earphone microphone 34 of the nozzle operator. Thus, in this system, power line communication is made in which the three kinds of signals, i.e. the operation control signal, condition display signal and call signal are superposed on power supply in the power source lines 33.

In this system, all the nozzle control units 8 including the body of the pump 1 are in an equal relation, and the same operation and display action can be performed in all the nozzle control units 8. In this case, a priority order between the nozzle control units 8 is not set. When commands conflict with each other, a priority is given to a preceding command. However, a priority order is given to the contents of commands, and a command on the side of safety is always preferentially processed. For example, when an engine starting command and an engine stopping command conflict with each other at the same time or within a predetermined period of time, the stopping command is preferentially processed, and the starting of the engine is not carried out.

Thus, in the nozzle control unit 8, the operation condition of the pump 1 including a revolution frequency of the engine which a nozzle operator could not know in the past can be known in real time. Accordingly, it is possible to accurately seize information on whether the engine has really been stopped or whether the regulating of the degree of opening of the throttle has been done as intended, without requiring waiting for the occurrence of variation of a water discharge rate after a key pressing operation.

In the above mode of embodiment, a portable fire pump is taken as an example and described but a pump to which the system according to the present invention can be applied is not limited thereto. The present invention can also be applied to various other types of pumps, such as a vehicle-mounted type pump, an installation type pump, an equipment-installed type pump and the like. Although in FIGS. 1 and 2, a structure provided with two (five at most) nozzle control units 8 is shown, the number of the nozzle control units 8 to be installed is not limited thereto.

Figure 5:
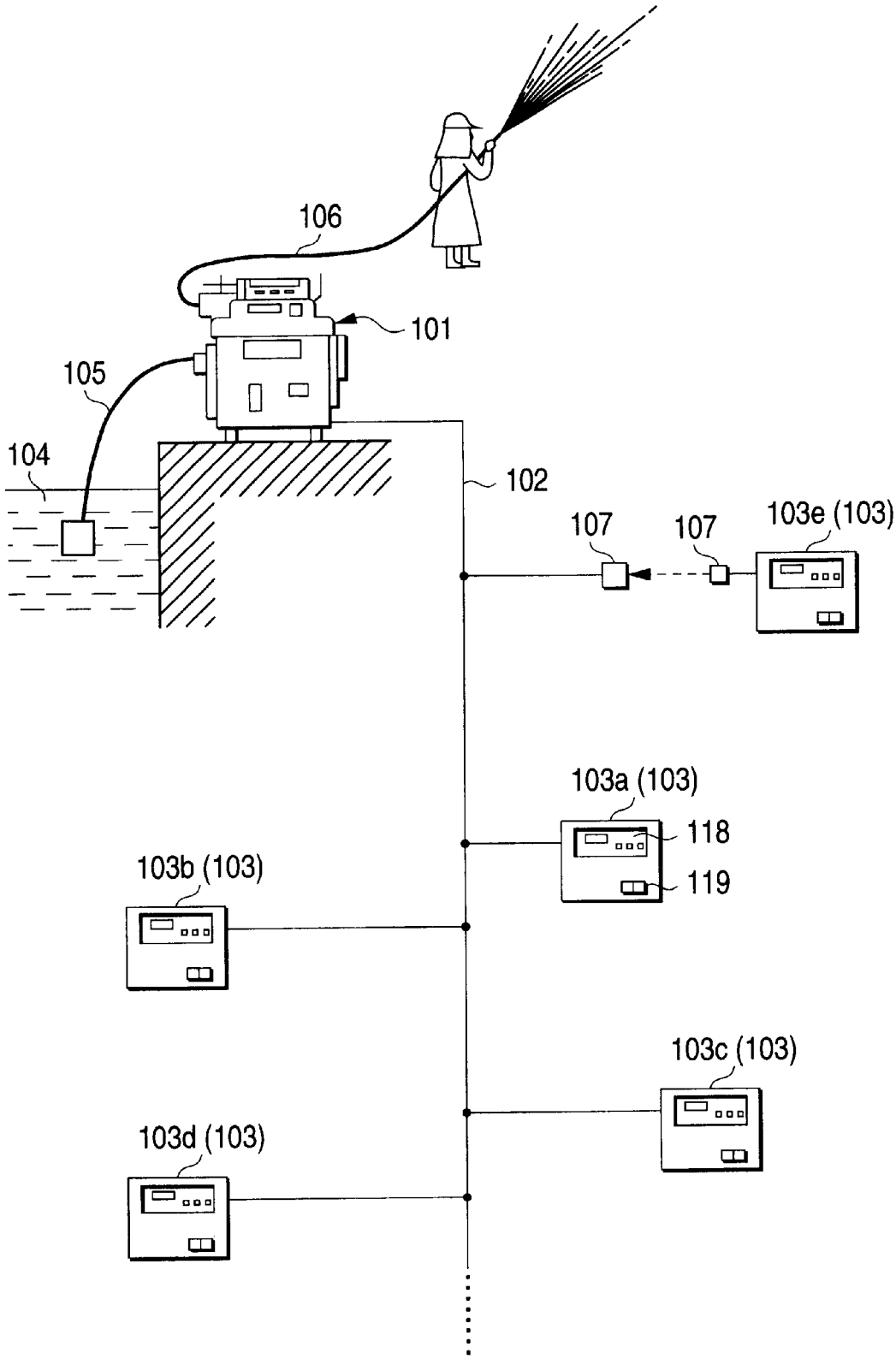
FIG. 5 is an illustration showing a general construction of a fire pump control system of an embodiment according to the present invention.
Figure 6:
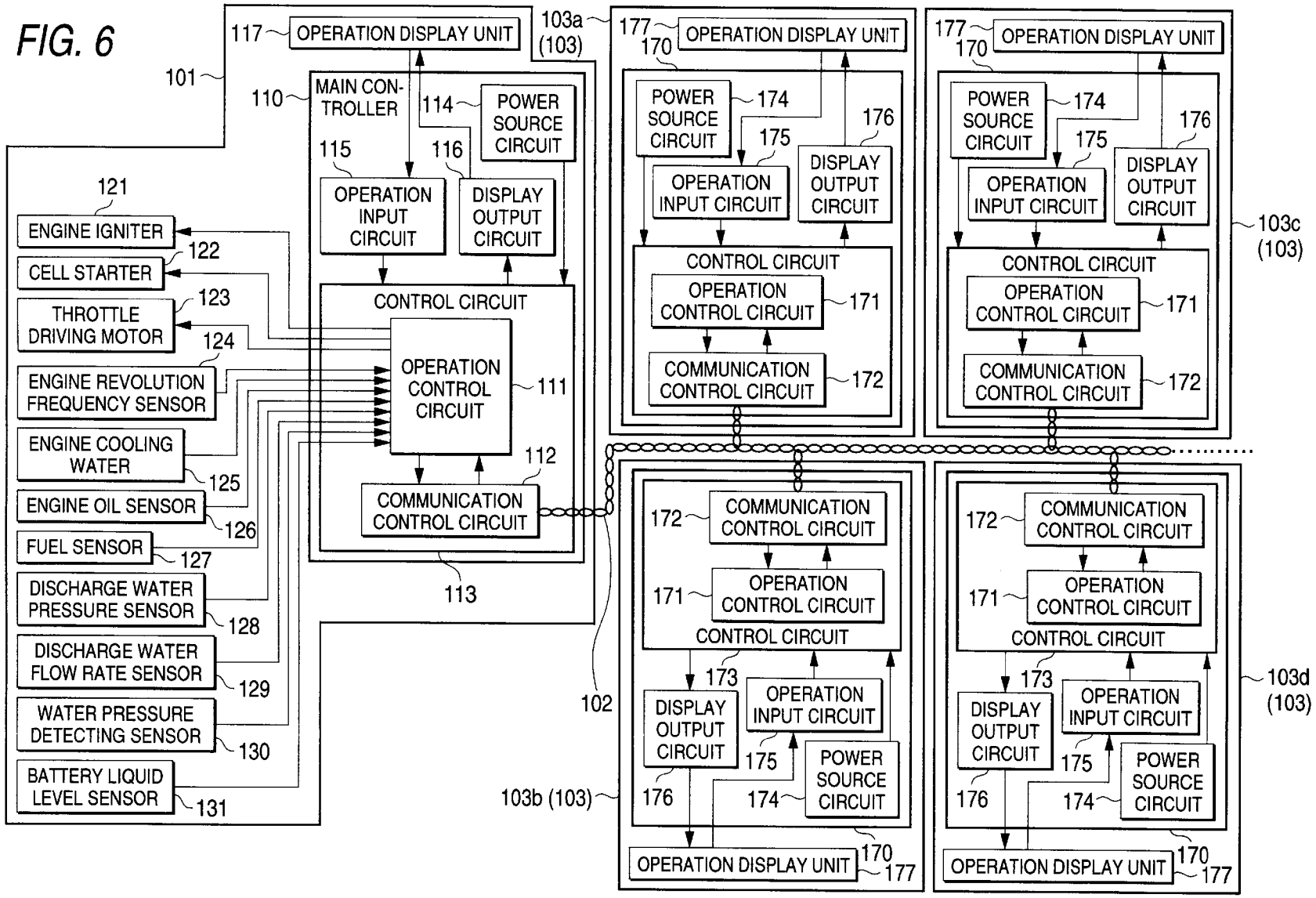
FIG. 6 is an illustration showing the construction of a control system in the system of FIG. 5.

Next, an operation display apparatus for a fire pump and an operation mode control apparatus of the fire pump according to the present invention will now be described in detail on the basis of the drawings. FIG. 5 illustrates a general construction of a fire pump control system using a fire pump having an operation display unit and the operation mode control unit according to the present invention. FIG. 6 illustrates the construction of a control system for the system of FIG. 5.

In the system of FIG. 5, a network is formed by connecting controllers (control units) 103 (103*a*–103*e*) to a fire fighting engine pump (which will hereinafter be referred to pump) 101 via a twisted pair line 102 so that the pump 101 can be controlled remotely by the controllers 103 as well. The system of FIGS. 5 and 6 is an example using a portable pump as the pump 101, which is provided with a water cooled 2-cycle engine and a vacuum pump driven thereby. The water is pumped up from a water source 104 via a suction pipe 105, and sent into a delivery hose 106 as a flow rate and a water pressure are regulated by the pump 101.

In this system, the pump 101 is controlled by a main controller 110 formed of a microcomputer held in the pump 101. The main controller 110 is provided with a control circuit 113 having a operation control circuit 111 and a communication control circuit 112 as shown in FIG. 6. In this case, the operation control circuit 111 and communication control circuit 112 are provided respectively with a CPU, a ROM, a RAM, a timer, an input/output (I/O) member, an A/D member, etc. (none of which are shown), and adapted to control an engine, etc. on the basis of detected data from various kinds of sensors.

Various kinds of actuators, such as an engine igniter 121, a cell starter 122, a throttle driving motor 123, etc. and various kinds of sensors, such as an engine revolution frequency sensor 124, an engine cooling water temperature sensor 125, an engine oil sensor 126, a fuel sensor 127, a discharge water pressure sensor 128, a discharge water flow rate sensor 129, a water pressure detecting sensor 130, a battery liquid level sensor 131, etc. are connected to the operation control circuit 111. The water pressure detecting sensor 130 is a sensor used exclusively for executing a relay water supplying operation, and adapted to detect a pressure (supply water pressure) of the water supplied to the pump 101, whereby the starting, throttle controlling, stopping, etc. of the engine are carried out automatically.

The operation control circuit 111 constantly monitors the sensors while the power source is on. The reasons reside in the following. It is difficult to detect a failure of a fire pump in advance since the pump is not a constantly-used machine, and, when a failure of the pump occurs while the pump is used, the failure has to be dealt with immediately. Accordingly, a diagnosis of the sensors is started at the same time as the power source is turned on. When an output value of a sensor is not lower than a predetermined level or not higher than a predetermined level, a judgement that an error occurs is made, and an operation for dealing with the error is carried out. Namely, the displaying of the error is done on an operation display panel 118, which will be described later, to notify an operator of the occurrence of an error, whereby the occurrence of an error can be ascertained immediately while the power source is on. When the error is in a certain condition during this time, the engine is stopped so as to prevent trouble due to the error from expanding, and notify the operator of the error positively.

The operation control circuit 111 further carries out the zero-setting of the water pressure detecting sensor 130 automatically. The reason resides in that, when the position of a water source is higher than that of the pump as in a roof water supply system, an error occurs in a detected value from a sensor due to the atmospheric pressure, correcting such an error enabling an accurate control operation to be carried out. This correcting operation is carried out by pressing a power source key 151 on an operation display panel 118 which will be referred to later. A pressure at the time of the execution of this operation is set as a reference value (0), values detected by the sensor before and after the correction operation being stored in the RAM in the operation control circuit 111. Therefore, while the power source for the pump 101 is on, the zero resetting of a sensor is done automatically, and, when the power source key 51 is pressed at a desired point in time, the zero resetting of the sensor can also be done at the same point in time.

The main controller 110 further has a power source circuit 114, an operation input circuit 115 and a display output circuit 116. The power source circuit 114 is connected to a battery and adapted to supply a power source current to a control circuit 113. The operation input circuit 115 is adapted to receive a command from an operation display unit 117. The display output circuit 16 is adapted to output various kinds of actual data on the pump 101 to the operation display unit 117 in accordance with a command given by an operator. In this case, the operation display unit 117 is provided with an operation display panel 118 and a throttle operating key 119, which are arranged on an upper surface of the pump 101.

Figure 7:
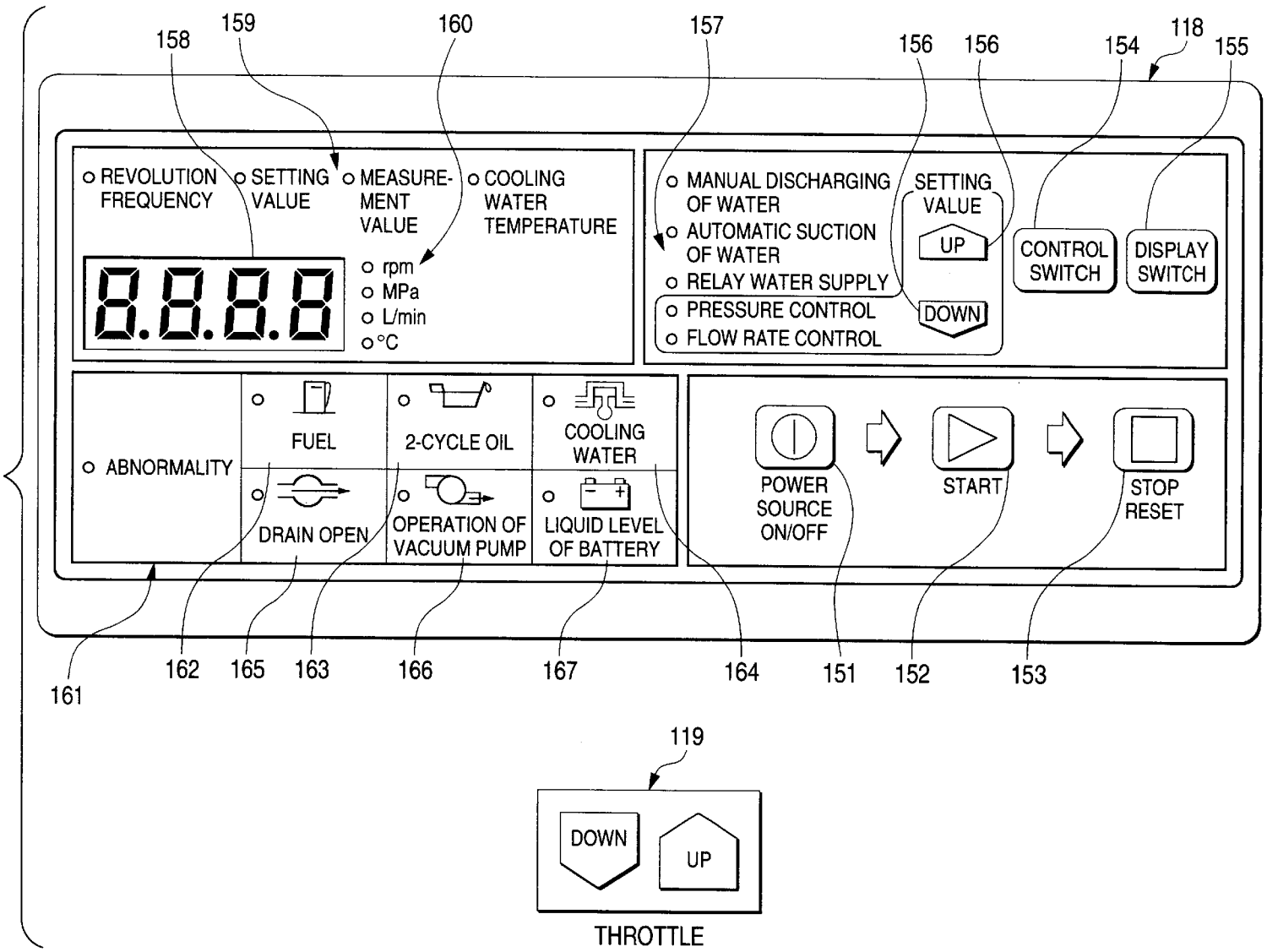
FIG. 7 is an illustration showing the construction of an operation display unit.

FIG. 7 illustrates the construction of the operation display unit 117, in which various kinds of switch keys (operating unit) and a display unit are provided on the side of the operation display panel 118. In this case, the operating unit is provided on a right side portion of the operation display panel 118, and the display unit on a left side portion thereof taking into consideration the convenience of operators most of whom are right-handed. First, on a right lower portion of the operating unit, the power source key 151, an engine starting key 152, and an engine stopping/resetting key (engine stopping key) 153 are provided. On a right upper portion thereof, an operation mode switching key (operation mode switching unit) 154, a display switching key 155 and a set value changing key 156 are provided.

These keys produce when operated a operation sound (operation reception sound), such as a piping sound and the like, whereby an operator can certainly ascertain the fact that the apparatus has received the operation, and whereby the sound arouses the operator's attention to the switching of a mode. The engine stopping/resetting key 153 is set so that an operation thereof becomes effective only when the operation is carried out continuously for a predetermined period of time. Namely, the turning on and off of the power source cannot be done unless the key continues to be pressed for t seconds (for example, 3 seconds). Accordingly, this can prevent an erroneous actuation, such as an operator's inadvertent touch on the key from causing the power source to be turned on and off simply, i.e., the occurrence of an unexpected erroneous operation can be prevented.

On the left side of each of the keys on the right upper portion of the panel 118, a mode display lamp 157 for displaying an actual operation mode is provided. Every time the operation mode switching key 154 is pressed, the operation mode is switched to "manual discharging of water"→"automatic suction of water"→"relay water supply (automatic relay water supply)"→"pressure control"→"flow rate control"→"manual discharging of water" in the mentioned order, and the relative mode display lamps 157 are also turned on in accordance with these changes of the mode.

In the operation display unit 117 in this case, delay time is set between the time of starting a mode switching operation and that of the setting of the mode, so that a mode is not fixed simultaneously with the starting of a mode switching operation. The reason why such a delay time is set in this manner is as follows. When the operation mode switching key 154 is formed so that, every time the operation mode switching key 154 is pressed, a mode is changed immediately and fixed, inconvenience occurs, i.e., when an input pressure of not lower than a predetermined level is detected, there is the possibility that the mode cannot be switched to "relay water supply" onward.

Namely, the "relay water supply" mode is set so that, when an input water pressure reaches a predetermined level, the engine is started automatically to start the relay water supply. For example, in a case where the water sent from a pump on a preceding stage is received, or in a case where the water supplied from a roof water tank is received, it is conceived that, in spite of the provision of the above-mentioned zero resetting function, an input water pressure has become not lower than a starting pressure due to a later change in the condition. When during this time the operation mode is switched, for example, from "automatic suction of water" to "pressure control", the engine is started at the moment the operation mode switching key 154 is pressed, so that the mode is changed to "relay water supply" to cause the "relay water supply" to be started and fixed to render it impossible to switch the mode to "pressure control".

When the pump is once operated in the "relay water supply" mode, the mode is stored even after the power source is turned off, so that a subsequent operation is started in the same mode. Therefore, even when the power source is turned off so as to stop the "relay water supply" mode, the pump is operated in the "relay water supply" mode after all, and the pump cannot get out of this mode.

Under the circumstances, this pump 101 is provided with delay time between the mode changing time and the time of setting thereof to prevent the relay mode from being fixed, in such a manner that, even when the operation mode switching key 154 is pressed, a subsequent mode is not fixed immediately. Namely, when the operation mode switching key 154 is pressed to switch a mode to a subsequent mode, the mode is not fixed for t seconds (for example, 3 seconds); the mode is fixed after the lapse of t seconds. During the delay time, the mode display lamp 157 flashes to show an operator that the setting of the mode is being waited for. When the mode is fixed after the lapse of t seconds, the mode display lamp is put in a continuously lighting state, and an operation in the relative mode is started. This enables the selection of a mode to be carried out freely without causing the setting of a mode to occur even when an input pressure not lower than a starting pressure is applied to the pump.

The controlling of these operations is done by the operation control circuit 111 which functions as a mode setting delay device. Namely, when a operation mode is switched by pressing the operation mode switching key 154 on the operation display panel 118, a command generated is inputted into the operation control circuit 111 via the operation input circuit 115. The operation control circuit 111 which has received this signal measures the time by using a timer every time a operation mode is switched on the basis of the delay time t stored in the ROM. During the measurement of the time, a signal for flashing the mode display lamp 157 is outputted from the operation control circuit 111 to the display output circuit 116. A certain operation mode is then selected, and, when t seconds has elapsed after the selection of the mode, the operation control circuit 111 fixes the same operation mode, and carries out an operation in the mentioned mode. At the same time, a signal for turning on the mode display lamp 157 relative to the selected and executed mode is outputted to the display output circuit 116.

The operation display panel 118 is provided on its left upper portion with a numerical value display unit 158 (display unit) formed of 7-segment display device. On an upper portion of the numerical value display unit 158, a numerical value attribute display member 159 indicating the attribute of numerals shown thereon is provided. On the right side of this numerical value attribute display member 159, a unit display member 160 indicating the unit of a numerical value is provided. Every time the display switching key 155 is pressed, the display mode is switched to "engine revolution frequency"→"discharge pressure or discharge flow rate setting value"→"discharge pressure or discharge flow rate measurement value"→"engine cooling water temperature"→"engine revolution frequency" in the mentioned order, and the lamps relative to the modes on the numerical value attribute display member 159 and unit display member 160 are also turned on in order.

Thus, in this pump 101, operation information including a revolution frequency of the engine, a temperature of the engine cooling water, a flow rate of discharge water, etc., which an operator could not know in the past, can be known easily by an operator's single switching operation. Moreover, a discharge pressure which was read on a manometer in the past can be ascertained on a digital display without carrying out an operation for reading what is indicated by a vibrating pointer. Accordingly, it becomes possible to obtain accurate information on the condition of the pump 101 more extensively, and carry out a more accurate operation.

On the numerical value display unit 158, not only numerical data but also various kinds of messages are also displayed. For example, when the degree of opening of a throttle is increased by a throttle operating key 119 to cause the throttle to be fully opened with the degree of opening of the throttle ceasing to increase any more, a message "FULL" is displayed. Instead of the 7-segment device, a plasma display may also be used as the numerical display unit 158, and, when in this case the engine starting key 152 and the engine stopping/resetting key 153 are pressed, indications "START", "STOP", etc. are displayed. When the zero resetting operation is carried out, "0SET" is displayed, and, when this is then returned to an initial condition, "INIT" (meaning "initial") is displayed.

Figures 8, 9:
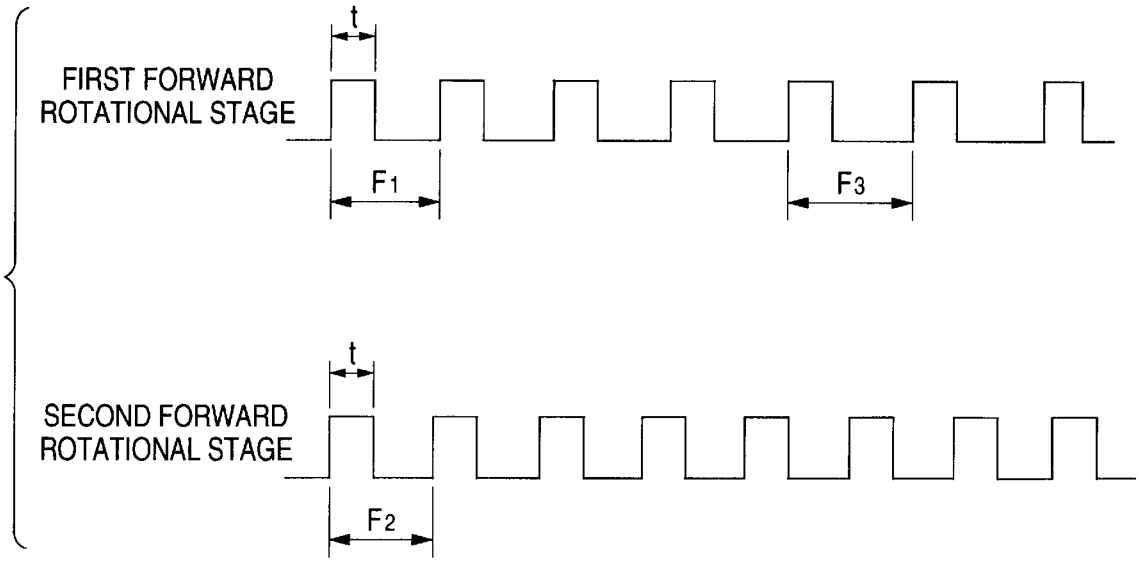
FIG. 8 is a table showing an example of error codes.
FIG. 9 is an illustration showing an example of a pulse voltage applied to the controlling of a throttle driving motor.

When an error is detected by a sensor abnormality diagnosis made by the operation control circuit 111, an error indication "Err.1", etc. are displayed in accordance with the kind of the error on the numerical display unit 158. FIG. 8 is a table showing examples of error codes, and, when "Err.1" is displayed, it indicates that a failure occurs in the discharge water pressure sensor 128. The releasing of the displaying of an error is done by the engine stopping/resetting key 153. Not only the displaying of an error but also the sounding of an alarm buzzer may be carried out at the same time.

On a left lower portion of the operation display panel 118, an abnormality alarm display unit 161 is provided. This abnormality alarm display unit 61 is provided first with alarm lamps for an engine system, including a fuel alarm lamp 162, an engine oil alarm lamp 63, and an engine cooling water temperature alarm lamp 164. The fuel alarm lamp 162 is adapted to be lit when a remaining quantity of a fuel becomes not higher than a predetermined level. The engine oil alarm lamp 163 is adapted to be lit when a remaining quantity of an engine oil becomes not higher than a predetermined level. The engine cooling water temperature alarm lamp 164 is adapted to be lit when a temperature of engine cooling water becomes not lower than a predetermined level. The abnormality alarm display unit 161 is further provided with a drain cock alarm lamp 165, a pump operation alarm lamp 166, and a battery liquid level alarm lamp 167. The drain cock alarm lamp 165 is adapted to be lit when a drain cock, which is used for the extraction of the fuel carried out in a case where the fuel is stored for a long period of time, is opened. The pump operation alarm lamp 166 is adapted to be lit during an operation of a vacuum pump. The battery liquid level alarm lamp 167 is adapted to be lit when the liquid level of a battery becomes not higher than a predetermined level.

Below the operation display panel 18, a throttle operating key 119 is provided so that the opening and closing of a throttle valve can be done by an operation of this key. In this pump 101, the throttle valve is opened and closed by a throttle driving motor 123 formed of a DC motor, and controlled by the operation control circuit 111.

Among the related art fire pumps in the past, a fire pump in which a throttle valve of an engine was opened and closed by using a motor existed. In such a fire pump, a control operation was limited to an ON/OFF control operation by a motor, and a fine valve regulating operation was not carried out. In order to carry out an automatic control operation for a discharge pressure and a discharge flow rate, a fine throttle regulating operation is required. A mere ON/OFF control operation causes hunting to occur, and is difficult to serve as a method of obtaining a predetermined level of output. Moreover, when the relay water supply is done, it is necessary to finely regulate a discharge pressure, etc. following up the pulsation of the water sent from a preceding stage, and the ON/OFF control operation is unable to attain a fine follow-up control.

Therefore, in the pump 101, a speed control operation constituted by plural stages is carried out for the throttle driving motor 123, whereby a fine degree-of-opening regulating operation of excellent follow-up characteristics is attained. Namely, a pulse voltage shown in FIG. 9 is applied to the throttle driving motor 123, and a speed control operation constituted by a total of 16-stages including, for example, 7-forward rotational stages, 8-backward rotational stages and 1-stopping stage is carried out in accordance with a duty ratio in its ON time/OFF time. FIG. 9 illustrates an example of pulse voltage applied to the control operation for the throttle driving motor 123.

In this control operation, a duty frame F (length of one cycle of pulse) of a pulse voltage can be set arbitrarily on each control stage. In FIG. 9, the duty frame F on the second forward rotational stage is set smaller ($F_1>F_2$). Furthermore, the duty frame F can also be set arbitrarily on each control stage. For example, the duty frame can be varied at the motor starting time and at the time thereafter. On a first forward rotational stage in FIG. 9, the duty frame F at the motor starting time is set small, and becomes gradually larger ($F_1<F_3$).

Even when the ON-time t on the control stages in this control operation is all set equal, the duty ratio can be varied arbitrarily by changing the duty frames F. Accordingly, when a certain ON-time $t_{\%}$ is set, a stepped rotation control operation can be attained, and a stepped regulating operation can also be carried out easily.

A speed of the motor may be controlled gradually by setting the duty frames F of each of the control stages equal, and the length of the ON-time t different. Namely, it is also possible to set a rotational speed of the motor on the second forward rotational stage higher than that on the first forward rotational stage by setting the ON-time t on the second forward rotational stage longer than that on the first forward rotational stage. The duty frame F and the length of ON-time t are rendered capable of being set arbitrarily, whereby an extensive control operation can also be carried out.

Thus, in the pump 101, the duty frame F is rendered able to be set arbitrarily on each control stage, whereby the range of a control mode expands to enable a fine control operation to be attained by simple setting work.

In this pump 101, an example using a DC motor as the throttle driving motor 123 is shown but the kind of the motor used is not limited thereto. For example, a stepping motor and an AC motor may also be used. When a stepping motor is used, a pulse control operation identical with that described above may be carried out. When an AC motor is used, a frequency control operation using an inverter may be carried out.

In the system of FIGS. 5 and 6, the pump 101 can be controlled remotely by the controller 103 as well. Namely, in this system, the twisted pair line 102 which is less attenuated than a parallel type conductor, and which is rarely influenced by the noise as compared with the parallel type conductor, is connected to form a network, and a distributed type communication control operation is carried out between the pump 101 and plural controllers 103, whereby the multiple remote controlling of the pump 101 is attained.

In this system, the controllers 103 can be connected and removed at any portion of the twisted pair line 102 . Namely, the controllers 103 can be arranged suitably as those 103*a*–103*d* of FIG. 5, and, moreover, increased (255 units at most). As in the controller 103*e*, connectors 107 may be provided so as to connect a controller thereto suitably as necessary.

As shown in FIG. 6, the controller 103 is provided with a control unit 170 formed of a microcomputer, in which a control circuit 173, a power source circuit 174, an operation input circuit 175 and a display output circuit 176 are provided just as in the main control unit 110 in the pump 101. The control circuit 173 is provided with a operation control circuit 171 and a communication control circuit 172, and connected to the twisted pair line 102 by the communication control circuit 172. The twisted pair line 102 is connected to the communication control circuit 112 in the main control unit 110 of the pump 101. The controller 103 and the pump 101 are adapted to transmit and receive signals to and from each other via the twisted pair line 102.

In this system, a network system called p-CSMA (p-persistent, Carrier, Sense, Multiple, Access) is employed, which is set so as to maintain through-put at a high level and minimize the probability of collision even when the network is put in a saturated state in a tense actual spot in which a fire occurs.

Figure 10:
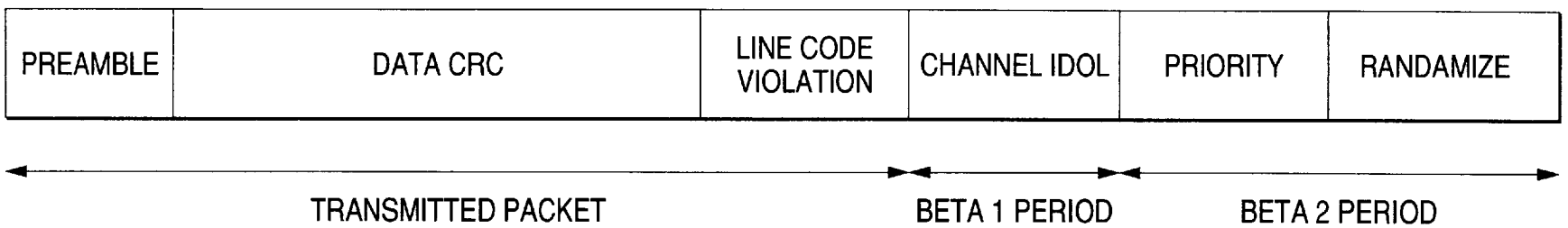
FIG. 10 is an illustration showing the structure of a signal in a p-CSMA system.

FIG. 10 illustrates a structure of a signal in the p-CSMA system. As shown in FIG. 10, packets to be transmitted in the p-CSMA system are sent in the heels of a period slot of Beta 1 and some period slots of Beta 2. The Beta 1 and Beta 2 periods have widths large enough for all the controllers 103 on the relative network to detect the starting of sending out signals from other controllers 103, and restrain the starting of sending out signal from a subject controller itself in a subsequent Beta 2 slot. Each controller 103 generates a random number of 1–16 when the controller 103 is ready to send a packet. The controller 103 determines a Beta 2 slot in a subsequent packet cycle from which a signal is to be transmitted, whereby the collision of signals is avoided.

The controller 103 is provided with an operation display unit 177 identical with that of FIG. 7, on which an operation display panel 118 and a throttle operating key 119 are arranged. The operation display unit 177 is connected to the control circuit 173 via the operation input circuit 175 and the display output circuit 176. A control signal is outputted from the communication control circuit 172 to the pump 101 via the twisted pair line 102 by an operation of a key on the operation display panel 118 and the throttle operating key 119 on the basis of a command from the operation control circuit 171. Namely, when the engine starting key 152 is operated in, for example, the controller 103*a*, an operating signal therefrom is transmitted to "communication control circuit 172→twisted pair line 102→communication control circuit 112", and the cell starter 122 is driven by a command from the operation control circuit 111 to cause an engine of the pump 101 to be started.

On the other hand, various kinds of data including an engine revolution frequency, a discharge water pressure, etc. are sent out into the twisted pair line 102. The operation control circuit 171 of each controller 103 obtains these data via the communication control circuit 172, and the relative data are displayed on the operation display panel 118 in accordance with what is selected by an operator. For example, when a display switching key 155 is operated to select the display of "engine revolution frequency", the operation control circuit 171 selects "engine revolution frequency" among the data obtained from the pump 101, and outputs the same to the display output circuit 176. Consequently, a lamp of "rpm" on the unit display member 160 on the operation display panel 118 is tuned on, and a numerical value "3000", etc. is displayed on the numerical display unit 158.

In this case, all the controllers 103 including the body of the pump 101 in this system are in equal relation, and the same operation and display can be carried out in all the controllers 103. Accordingly, even when the pump 101 exists in a place away from a scene of a fire, the controlling of the pump 101 can be done from an optimum position out of the positions between a position close to the scene of a fire and the position of the pump body. A priority order among the controllers 103 is not set, and, when commands concur, a preceding command is preferentially dealt with. However, a priority order of the contents of commands is set, and a command on the side of safety is always preferentially dealt with. For example, when an engine starting command and an engine stopping command conflict at the same time or within a predetermined period of time, the stopping command is preferentially dealt with, and the starting of the engine is not carried out.

Thus, in this system, a network is formed by using a twisted pair line 102 having a low price, light weight and, moreover, a high attenuation and noise resistance, and capable of being easily installed, and a pump 101 is communication-controlled by controllers 103. Therefore, a high-degree remote control operation can be carried out by wiring simpler than that in a heretofore-available system. Accordingly, it becomes possible that not only such a solely set pump 101 as shown in FIG. 5 but also a pump of a portable pump-mounted vehicle and the like be controlled as the operation condition of the pump is monitored in a distant place.

In the above-described mode of embodiment, a portable fire pump is taken as an example and described. A pump to which the operation display apparatus according to the present invention can be applied is not limited to such a pump. The present invention can also be applied to various other types of pumps, such as a vehicle-mounted type pump, an installation type pump, an installation set type pump, etc.

Although, in the mode of embodiment, a structure for supplying water by the pump 101 alone is shown, the relay water supply can also be done by connecting similar pumps on plural stages. Namely, this pump 101 can employ not only a structure in which the water is supplied by a pump alone as shown in FIGS. 5 and 6 but also a structure in which the relay water supply is done by series-connecting identical pumps on plural stages. In this case, a main control unit of a pump on a final stage constitutes the main control unit 110 shown in FIG. 6, and a pump on its preceding stage works as a controller. When during this time the water pressure detecting sensor 130 detects a water pressure of not lower than a predetermined level with the pump on each stage set to a "relay water supply" mode, the starting, throttle controlling and stopping of the engine are done automatically. The water is sent to a subsequent stage as a feed water pressure and a feed water flow rate are controlled by the multi-stage controlling of the throttle driving motor 123 on the basis of a water supply pressure and a flow rate on the preceding stage.

In the control apparatus for fire pumps according to the present invention, a nozzle control unit adapted to remotely control a fire pump is provided in the vicinity of a nozzle, and the transmitting and receiving of an operation control signal and a condition display signal are done between this nozzle control unit and a fire pump body by power line communication via power source lines, whereby the operation condition of the pump including a revolution frequency of an engine, etc. is feedback displayed in real time in response to a key pressing operation of a nozzle operator. Accordingly, the nozzle operator can ascertain the effect of a key pressing operation instantly, and it becomes possible to carry out an accurate and speedy transmission of information in tense circumstances. It also becomes possible to carry out an operation of the control apparatus and the discharging of water efficiently, and attain the improvement the operation efficiency and labor effectiveness.

Owing to the transmitting and receiving of call signals between a fire pump body and a nozzle control unit by power line communication via power source lines, vocally reporting the state of things and making a request for taking actions between the side of the nozzle and that of the pump body become possible, so that more accurate fire extinguishing actions can be performed.

Since the transmission of a signal from the nozzle control unit to the fire pump body is carried out by FM waves, a signal transmitted from the side of a scene of a fire having many noise generating sources comes to be rarely influenced by the noise, and this enables a more accurate signal transmission operation to be carried out.

In the operation display apparatus according to the present invention, each key on the operation display panel produces an operation reception sound with respect to every operation, so that an operator can certainly ascertain the fact that the apparatus has received the relative operation. Moreover, since operation information corresponding to a key pressing operation is indicated on the numerical value display unit, the operator's attention is aroused to the switching of a mode, etc., and it becomes possible that the operator accurately knows the moving condition of the pump.

Since the numerical value display unit employs a 7-segment display device, it becomes possible to digitally display various kinds of data, and display not only numerical data but also various kinds of messages. Therefore, the operation information can be ascertained by a digital display system without reading an indication of a pointer of an analog meter, so that accurate information on the condition of the pump can be obtained more extensively, whereby a more accurate pump control operation can be carried out.

Since a revolution frequency of the engine, a cooling water temperature, a discharge pressure of the pump, a discharge flow rate of the pump, etc. are shown on the numerical display unit, the operator can easily obtain operation information including a revolution frequency of the engine, etc. by one key pressing operation.

Furthermore, the function of the numerical value display unit is further utilized by showing an error of a sensor thereon, whereby it becomes possible to notify the operator of the results obtained owing to the function of diagnosing the abnormality of the pump.

In addition, since, for example, the engine stopping/resetting key on the operation display panel is set so that an operation of this key becomes effective only when the key is operated continuously for a predetermined period of time, it becomes possible to prevent an unexpected erroneous operation of the key ascribed to the operator's inadvertent touch thereon. Therefore, it becomes possible to prevent only the operator's touch on the apparatus stopping key from causing the power source to be turned on and off.

Since a key for zero setting the water pressure detecting sensor is provided on the operation display panel, the correcting of a detected value from the sensor can be done automatically or arbitrarily even when the pump setting conditions are such that cause an error to occur, for example, in a detected value from the sensor. This enables a more accurate control operation to be carried out.

In the operation mode control apparatus for fire pumps according to the present invention, when a operation mode is switched by a operation mode switching key, the setting of the operation mode after the mode switching operation is delayed for a predetermined period of time. Therefore, a operation mode is not fixed simultaneously with a operation mode switching operation. Even in a case where another mode cannot be selected in a related art apparatus unless a pump passes through an automatic relay water supply mode, an actual mode can be shifted easily to a mode beyond the automatic relay water supply mode. Consequently, even when the automatic relay water supply mode is selected with an input water pressure exceeding a pump starting water pressure, an actual mode is not fixed instantly to "automatic relay water supply". Accordingly, an actual mode can be shifted easily to another via the automatic relay water supply mode, so that a mode selection operation can be carried out freely.

While the presently preferred embodiment of the present invention has been shown and described, it is to be understood that this disclosure is for the purpose of illustration and that various changes and modifications may be made without departing from the scope of the invention as set forth in the appended claims.

What is claimed is:

1. An operation display apparatus for a fire pump, said operation display apparatus comprising:

an operation unit having at least one key for controlling an operation of the fire pump and for generating a sound corresponding to the control thereof;

wherein operation of the fire pump corresponding to the key is carried out only when the key is operated continuously for a predetermined period of time; and a display unit for displaying operation information on the fire pump corresponding to the operation of the fire pump controlled by said operation unit.

2. The operation display apparatus according to claim 1, wherein the key is for stopping a fire pump driving engine of the fire pump.

3. An operation display apparatus for a fire pump, said operation display apparatus comprising:

an operation unit for controlling an operation of the firepump and for generating a sound corresponding to the control thereof;

wherein said operation unit has a key for setting as a reference value a pressure at the time a water pressure detection sensor for detecting pressure of water supplied to the fire pump is operated; and a display unit for displaying operation information on the fire pump corresponding to the operation of the fire pump controlled by said operation unit.

* * * * *

UNITED STATES PATENT AND TRADEMARK OFFICE

CERTIFICATE OF CORRECTION

PATENT NO. : 6,651,900 B1
DATED : November 25, 2003
INVENTOR(S) : Yoshida, Kenichi It is certified that error appears in the above-identified patent and that said Letters Patent is hereby corrected as shown below:

Title page,
Item [73], Assignee, should read as follows:
-- Fuji Jukogyo Kabushiki Kaisha, Tokyo (JP) --

Signed and Sealed this

Sixteenth Day of March, 2004

JON W. DUDAS
*Acting Director of the United States Patent and Trademark Office*